US008312928B2

(12) United States Patent
Lockhart et al.

(10) Patent No.: US 8,312,928 B2
(45) **Date of Patent: *Nov. 20, 2012**

(54) APPARATUS AND METHODS FOR THE RECOVERY OF HYDROCARBONACEOUS AND ADDITIONAL PRODUCTS FROM OIL SHALE AND OIL SANDS

(75) Inventors: Michael D. Lockhart, Charlottesville, VA (US); Ron McQueen, Park City, UT (US)

(73) Assignee: General Synfuels International, Inc., Delta, CO (US)

( * ) Notice: Subject to any disclaimer, the term of this patent is extended or adjusted under 35 U.S.C. 154(b) by 426 days.

This patent is subject to a terminal disclaimer.

(21) Appl. No.: 12/421,325

(22) Filed: Apr. 9, 2009

(65) Prior Publication Data

US 2010/0258317 A1 Oct. 14, 2010

(51) Int. Cl.
*E21B 43/24* (2006.01)

(52) U.S. Cl. ..... 166/303; 166/75.12

(58) Field of Classification Search ..... 166/302, 166/303, 75.12

See application file for complete search history.

(56) References Cited

U.S. PATENT DOCUMENTS

| | | | | | |
|---|---|---|---|---|---|
| 3,749,170 | A | | 7/1973 | Riehl | |
| 4,007,785 | A | * | 2/1977 | Allen et al. | 166/272.1 |
| 4,064,938 | A | | 12/1977 | Fast | |
| 4,455,221 | A | * | 6/1984 | Calderon et al. | 208/347 |
| 4,561,941 | A | | 12/1985 | Dinnage et al. | |
| 4,706,752 | A | | 11/1987 | Holm | |
| 4,939,905 | A | | 7/1990 | Manz | |
| 5,097,903 | A | * | 3/1992 | Wilensky | 166/266 |
| 5,401,364 | A | | 3/1995 | Rinker | |
| 6,540,023 | B2 | * | 4/2003 | Davis et al. | 166/303 |
| 6,653,517 | B2 | * | 11/2003 | Bullock | 585/241 |
| 7,041,051 | B2 | | 5/2006 | Bernstein | |
| 7,270,179 | B2 | * | 9/2007 | Mansuy | 166/250.07 |
| 2002/0156332 | A1 | | 10/2002 | Jiang | |
| 2002/0177745 | A1 | * | 11/2002 | Bullock | 585/240 |
| 2004/0149433 | A1 | | 8/2004 | McQueen | |
| 2005/0287056 | A1 | | 12/2005 | Baker et al. | |
| 2006/0006099 | A1 | | 1/2006 | Espinoza et al. | |
| 2007/0131427 | A1 | | 6/2007 | Li et al. | |
| 2009/0056944 | A1 | | 3/2009 | Nitschke | |
| 2010/0258315 | A1 | * | 10/2010 | Lockhart et al. | 166/303 |
| 2010/0258316 | A1 | * | 10/2010 | Lockhart et al. | 166/303 |

* cited by examiner

*Primary Examiner* — Daniel P Stephenson
*Assistant Examiner* — Catherine Loikith
(74) *Attorney, Agent, or Firm* — Gifford, Krass, Sprinkle, Anderson & Citkowski, P.C.

(57) ABSTRACT

Apparatus and methods for recovering hydrocarbonaceous and additional products from nonrubilized oil shale and oil/tar sands. One or more initial condensation steps are performed to recover crude-oil products from the effluent gas, followed by one or more subsequent condensation steps to recover additional, non-crude-oil products. At least a portion of the exhaust gas from a combustor may be routed through a heat exchanger to produce the processing gas, the composition of which may be adjusted so that it contains approximately 1% oxygen or less. The subsequent condensation steps may be carried out in at least one cooled chamber having a sequence of critical orifices maintained at a negative pressure. Carbon sequestration steps may be performed wherein recovered carbon dioxide is delivered down the hole following the recovery of the hydrocarbonaceous products. Various physical parameters may be adjusted to vary the recovery of crude oil or other products or contaminants from the effluent gas.

29 Claims, 3 Drawing Sheets

APPARATUS AND METHODS FOR THE RECOVERY OF HYDROCARBONACEOUS AND ADDITIONAL PRODUCTS FROM OIL SHALE AND OIL SANDS

FIELD OF THE INVENTION

The present invention relates generally to the recovery of hydrocarbonaceous products from oil shale and oil/tar sands and, in particular, to a process and system for recovering such products and byproducts with significantly reduced environmental impact.

BACKGROUND OF THE INVENTION

The term "oil shale" refers to a sedimentary rock interspersed with an organic mixture of complex chemical compounds collectively referred to as "kerogen." The oil shale consists of laminated sedimentary rock containing mainly clay with fine sand, calcite, dolomite, and iron compounds. Oil shales can vary in their mineral and chemical composition. When the oil shale is heated to above 250-400° F., destructive distillation of the kerogen occurs to produce products in the form of oil, gas, and residual carbon. The hydrocarbonaceous products resulting from the destructive distillation of the kerogen have uses which are similar to petroleum products. Indeed, oil shale is considered to be one of the primary sources for producing liquid fuels and natural gas to supplement and augment those fuels currently produced from petroleum sources.

Processes for recovering hydrocarbonaceous products from oil shale may generally be divided into in situ processes and above-ground processes. In situ processes involve treating oil shale which is still in the ground in order to remove the hydrocarbonaceous products, while above-ground processes require removing the oil shale from the ground through mining procedures and then subsequently retorting in above-ground equipment. Clearly, in situ processes are economically desirable since removal of the oil shale from the ground is often expensive. However, in situ processes are generally not as efficient as above-ground processes in terms of total product recovery.

Historically, prior art in situ processes have generally only been concerned with recovering products from oil shale which comes to the surface of the ground; thus, prior art processes have typically not been capable of recovering products from oil shale located at great depths below the ground surface. For example, typical prior art in situ processes generally only treat oil shale which is 300 feet or less below the ground surface. However, many oil shale deposits extend far beyond the 300 foot depth level; in fact, oil shale deposits of 3000 feet or more deep are not uncommon.

Moreover, many, if not most, prior art processes are directed towards recovering products from what is known as the "mahogany" layer of the oil shale. The mahogany layer is the richest zone of the oil shale bed, having a Fischer assay of about twenty-five gallons per ton (25 gal/ton) or greater. The Mahogany Zone in the Piceance Creek Basin consists of kerogen-rich strata and averages 100 to 200 ft thick. This layer has often been the only portion of the oil shale bed to which many prior art processes have been applied.

For economic reasons, it has been found generally uneconomical in the prior art to recover products from any other area of the oil shale bed than the mahogany zone.

Thus, there exists a relatively untapped resource of oil shale, especially deep-lying oil shale and oil shale outside of the mahogany zone, which have not been treated by prior art processes mainly due to the absence of an economically viable method for recovering products from such oil shale.

Another important disadvantage of many, if not most prior art in situ oil shale processes is that expensive rubilization procedures are often necessary before treating the oil shale. Rubilization of the in situ oil shale formation is typically accomplished by triggering underground explosions so as to break up the oil shale formation. In such prior art process, it has been necessary to rubilize the oil shale formation so as to provide a substantial reduction in the particle size of the oil shale. By reducing the particle size, the surface area of the oil shale treated is increased, in an attempt to recover a more substantial portion of products therefrom. However, rubilization procedures are expensive, time-consuming, and often cause the ground surface to recede so as to significantly destroy the structural integrity of the underground formation and the terrain supported thereby. This destruction of the structural integrity of the ground and surrounding terrain is a source of great environmental concern.

Rubilization of the oil shale in prior art in situ processes has a further disadvantage. Upon destructive distillation of the kerogen in the oil shale to produce various hydrocarbonaceous products, these products seek the path of lease resistance when escaping through the marlstone of the oil shale formation. By rubilizing the oil shale formation, many different paths of escape are created for the products; the result is that it is difficult to predict the path which the products will follow. This, of course, is important in terms of withdrawing the products from the rubilized oil shale formation so as to enable maximum recovery of the products. Since the products have numerous possible escape paths to follow within the rubilized oil shale formation, the task of recovering the products is greatly complicated.

Oil/tar sands, often referred to as 'extra heavy oil,' are types of bitumen deposits. The deposits are naturally occurring mixtures of sand or clay, water and an extremely dense and viscous form of petroleum called bitumen. They are found in large amounts in many countries throughout the world, but are found in extremely large quantities in Canada and Venezuela.

Due to the fact that extra-heavy oil and bitumen flow very slowly, if at all, toward producing wells under normal reservoir conditions, the sands are often extracted by strip mining or the oil made to flow into wells by in situ techniques which reduce the viscosity by injecting steam, solvents, and/or hot air into the sands. These processes can use more water and require larger amounts of energy than conventional oil extraction, although many conventional oil fields also require large amounts of water and energy to achieve good rates of production.

Like all mining and non-renewable resource development projects, oil shale and sands operations have an effect on the environment. Oil sands projects may affect the land when the bitumen is initially mined and with large deposits of toxic chemicals, the water during the separation process and through the drainage of rivers, and the air due to the release of carbon dioxide and other emissions, as well as deforestation. Clearly any improvements in the techniques use to extract hydrocarbonaceous products from shale and sands would be appreciated, particularly if efficiency is improved and/or environmental impact is reduced.

Certain improvements with respect to the recovery of products from shale are disclosed in U.S. Pat. No. 7,041,051. Unlike other prior art processes, the in situ body of oil shale to be treated is not rubilized. Rather, the process includes drilling a hole in the body of nonrubilized oil shale, and locating a processing gas inlet conduit within the hole such that the bottom end of the processing inlet gas conduit is near the bottom of the hole. An effluent gas conduit is anchored around the opening of the hole at the ground surface of the body of oil shale. A processing gas is introduced into an above-ground combustor. In the combustor, the processing gas, which contains enough oxygen to support combustion, is heated by burning a combustible material introduced into the combustor in the presence of the processing gas. The resultant heated processing gas is of a temperature sufficient to convert kerogen in the oil shale to gaseous hydrocarbonaceous products.

The heat from the heated processing gas, as well as radiant heat from the processing gas inlet conduit, create a nonburning thermal energy front in the oil shale surrounding the hole. The kerogen is thus pyrolyzed and converted into hydrocarbonaceous products. The products produced during pyrolysis of the kerogen are in gaseous form and are withdrawn with the processing gas as an effluent gas through the hole and into the effluent gas conduit. The effluent gas is transferred through the effluent gas conduit into a condenser where the effluent gas is allowed to expand and cool so as to condense a portion of the hydrocarbonaceous products into a liquid fractions. In the condenser, a remaining gaseous fraction of hydrocarbonaceous products is separated from the liquid fraction of hydrocarbonaceous products. The gaseous fraction is preferably filtered and or scrubbed so as to separate the upgraded gas products from any waste gases including the inorganic gas carbon dioxide.

According to the '051 Patent, expensive and time-consuming rubilization procedures are eliminated, and the structural integrity of the ground and surrounding terrain are preserved. While a portion of the upgraded hydrocarbon gas may be recycled to the combustor to provide combustible material for fueling combustion within the combustor, and while a portion of the waste inorganic gas may be recycled to the compressor for augmenting the supply of carbon dioxide in the processing gas, further improvements are possible, both in the generation of the heated, processing gas as well as the recovery of products and byproducts produced in the condenser.

SUMMARY OF THE INVENTION

This invention is directed to apparatus and methods of recovering hydrocarbonaceous and additional products from nonrubilized oil shale and oil/tar sands. The method comprises the steps of forming a hole in a body of nonrubilized oil shale or sand, positioning a gas inlet conduit into the hole, and introducing a heated, pressurized processing gas into the hole through the inlet, thereby creating a nonburning thermal energy front sufficient to convert kerogen in oil shale or bitumen in oil sand to hydrocarbonaceous products. The processing gas and hydrocarbonaceous products are withdrawn as effluent gas through the hole, and a series of condensation steps are performed on the effluent gas to recover various products. In the preferred embodiment, a negative pressure relative to the well inlet pressure is maintained to insure positive flow of the combustion and product gases, this is performed by a method of blowers on the front and or back side of the well and the removal of mass during the condensation steps. Also in the preferred embodiment, one or more initial condensation steps are performed to recover crude-oil products from the effluent gas, followed by one or more subsequent condensation steps to recover additional, non-crude-oil products from the effluent gas. In conjunction with oil/tar sands, the method includes the step of providing an apertured sleeve within the hole to limit excessive in-fill.

Such additional products may include ethane, propane, butane, carbon dioxide, methane, nitrogen, or hydrogen, depending upon the type of processing gas, the nature of the crude-oil products, contamination in the well, and other factors. To create the processing gas, a fuel may be burned to produce an exhaust gas and heat used to heat a heat exchanger. At least a portion of the exhaust gas may be routed through the heat exchanger to produce the processing gas. To enhance efficiency, to reduce environmental impact, or to lower the oxygen content of the processing gas, at least one of the additional products may be mixed with the exhaust gas as make-up for the processing gas. According to a preferred embodiment, the composition of the processing gas may be adjusted so that it contains approximately 1 percent oxygen or less.

The subsequent condensation steps may be carried out in at least one cooled chamber having an input and an output, and a compressor system may be provided at the output of the cooled chamber to maintain the effluent gas at a negative pressure from the hole and through the initial and subsequent condensation steps. The cooled chamber preferably includes a plurality of critical orifices sized to recover the additional products. The chamber may be cooled with liquid carbon dioxide or other liquids or techniques, including carbon dioxide recovered from the effluent gas stream. In oil shale, the step of withdrawing the processing gas and hydrocarbonaceous products as effluent gas through the hole may be sufficient to withdraw at least a portion of the hydrocarbonaceous products from the shale through the Venturi effect.

A carbon sequestration step may be performed wherein recovered carbon dioxide is delivered down the hole following the recovery of the hydrocarbonaceous products. A plurality of well holes may be drilled, each with a gas inlet to receive a heated and pressurized processing gas. The processing gas and hydrocarbonaceous products may be withdrawn as effluent gas through each hole, and a plurality of condensation steps may be used to recover crude oil products and the additional products from the effluent gas from a plurality of the holes. The cracking and subsequent removal of hydrocarbonaceous products and associated gases opens the kerogen pores and significantly increases permeability in the now depleted oil shale rock. Once depleted these now vacant pores, having charred surface areas significantly greater than other carbon sequestration processes can now adsorb large volumes of carbon dioxide. As part of a carbon sequestration process, carbon dioxide may be introduced down a central well hole following the recovery of the hydrocarbonaceous products until the carbon dioxide is detected at one or more of the surrounding holes, thereby indicating saturation. This now represents a potentially significant increase in carbon sequestration potential over other techniques.

The crude oil products are typically recovered as a ratio of heavy crude to lighter crudes, in which case the flow rate of the processing gas may be adjusted to reduce the ratio. Alternatively, the reflux time of the heavy crude with respect to the initial condensation step may be increased to reduce the ratio. For that matter, one or more of the following parameters may be adjusted in accordance with the invention to vary the recovery of crude oil, other products or contaminants from the effluent gas:

the temperature, pressure or flow rate of the processing gas, the residency time of the processing gas in the hole, the reflux time of the crude oil with respect to the initial condensation step.

A basic system for recovering hydrocarbonaceous and other products from a hole drilled in nonrubilized oil shale and oil/tar sands comprises:

a combustor for heating and pressurizing a processing gas;

a gas inlet conduit for introducing the processing gas into the hole to convert kerogen in oil shale or bitumen in oil sand into hydrocarbonaceous products;

a gas outlet conduit for withdrawing the processing gas and hydrocarbonaceous products from the hole;

an initial condenser system for recovering crude oil products from the effluent gas; and a subsequent condenser system for recovering additional products from the effluent gas.

DETAILED DESCRIPTION OF THE INVENTION

In common with the teachings of U.S. Pat. No. 7,048,051 ("the '051 patent"), this invention is directed to the extraction of hydrocarbonaceous products from nonrubilized oil shale. The system and method are also applicable to recovery from oil sands and tar sands with appropriate engineering modification described in further detail herein.

Figure 1:
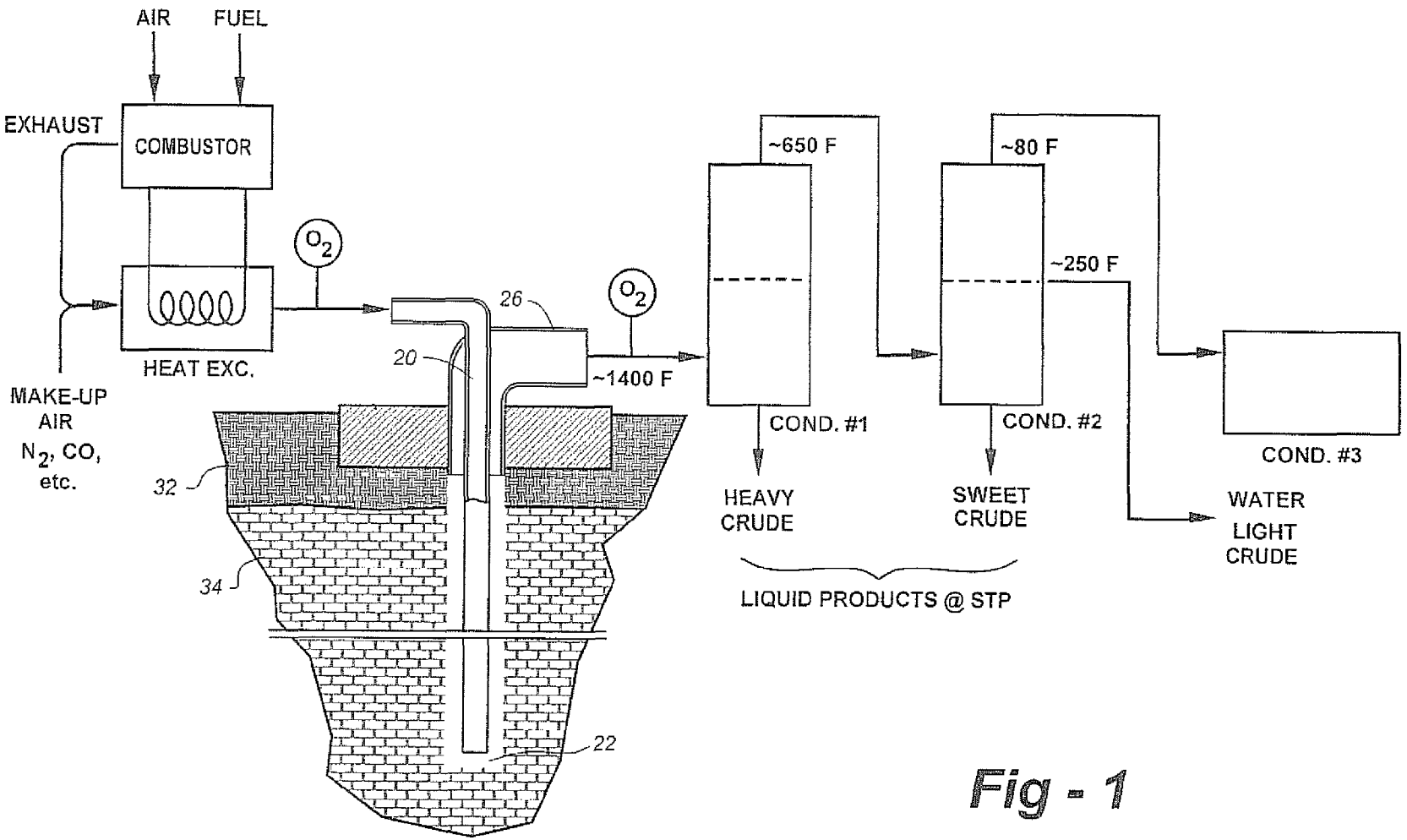
FIG. 1 is a schematic drawing showing improvements to both the injection and collection sides of a well.

Referring now to FIG. 1, a hole 22 is drilled through an overburden 32 and into an oil shale body or formation 34 to be treated. A processing gas inlet conduit 20 is disposed within hole 22. Preferably, the conduit 20 is constructed of a heat conductive and refractory material (for example, stainless steel) which is capable of withstanding temperatures of up to 2000° F. or greater. The processing gas inlet conduit 20 is preferably positioned within hole 22 by a distance of at least about twice the diameter of the conduit 20. An effluent gas conduit 26 is positioned around the opening of the hole 22 for receiving an effluent gas which includes the processing gas and hydrocarbonaceous products formed from the pyrolysis of the kerogen in the case of oil shale.

In the case of the '051 patent, the pressurized processing gas is air, which is heated by burning a combustible material introduced into combustor 16 through a supply conduit. The air is drawn from the ambient environment, compressed and delivered to the combustor by way of a gas conduit. While a recycling conduit may be provided between the gas conduit and the combustor 16 to facilitate the optional recycling of a portion of the gaseous fraction of hydrocarbonaceous products to the combustor 16. Although a mechanism can be provided for recycling a portion of the waste inorganic gas (which contains carbon dioxide) to the compressor 12 so as to augment the concentration of carbon dioxide in the processing gas, no details are provided with regard to carrying this out.

Processing Gas Considerations

The instant invention improves upon previous configurations by relying largely on gases other than air as the processing gas. Continuing the reference to FIG. 1, air and fuel enter the combustor where the fuel is burned, generating heat in a heat exchanger. Although the burner and heat exchanger are drawn as two separate boxes, they may be integrated as disclosed in the '051 patent. The primary gas flow entering the heat exchanger is the exhaust from the combustor itself. The circulation of the exhaust gas through the heat exchanger results in a closed-loop process that not only increases efficiency, it also provides an oxygen-deprived reduction environment in the extraction well.

In the preferred embodiment, the fuel used for the combustor is at least partially derived from the effluent gas stream through processes described elsewhere herein. As such applicable fuels may include straight or mixtures of methane, ethane, propane, butane, and or hydrogen and so forth. Air is used only as a "make-up" gas into the heat exchanger, and the level of make-up air may be adjusted so that gas used for extraction has an oxygen of 1 percent or less. The lower oxygen content in the processing gas is advantageous for several reasons. For one, higher levels of oxygen can auto-ignite down at the bottom of the well. In particular, oxygen content may be adjusted by chancing the fuel mixture of the combustor to achieve a very rich fuel mixture, thereby diminishing the level of oxygen. Oxygen sensors in communication with conduits 20 and 26 are preferably provided to monitor $O_2$ content into and out of the well to maintain desired operating conditions.

Like all burners, the combustor may only be 60 to 80 percent efficient. However, a boiler may be used to create steam, with the waste heat being used to run a turbine to create electricity as needed for different on-site operations.

Multi-Stage Condensation

An effluent gas conduit 26 is positioned around the opening of the hole 22 for receiving an effluent gas which includes the processing gas and hydrocarbonaceous products formed from the pyrolysis of kerogen. The effluent gas conduit 26 further serves to transfer the effluent gas to above-ground condenser units. The '051 patent discloses a single condenser that collected products emerging from the well as a vapor at standard temperature and pressure (STP). The liquid fractions of the hydrocarbonaceous products were removed from the bottom of the condenser; however, those portions that were or could not be condensed into a liquid at STP were vented to the atmosphere.

This invention improves upon the collection side of the system as well through multiple stages of condensation, with the goal being to recover all liquid and gaseous products.

The preferred embodiment incorporates three stages of condensation. The first stage collects only the heavy crude. The second stage collects the light and medium crudes and water; the last stage collects gaseous products, including methane, ethane, propane, butane, carbon dioxide, nitrogen and hydrogen. As with the reduced-oxygen processing gas improvements described earlier, the use of multiple condensation stages is considered patentably distinct. That is, while the combination of the processing gas improvements and multiple condensation stages achieves certain symbiotic benefits in combination, the improvements to the injection side and the collection side of the well may be used independently of one another. This third condenser stage, in particular, is applicable to industries outside of the petroleum industry; for example, the general gas industry, the chemical industry, and others.

Cooling coils are typically used in the first two condenser stages. The invention is not limited in this regard, however, in that other known devices such as coolant-filled 'thumbs' may alternatively be used. All of the products recovered by condensers one and two are liquid products at STP. In the oil industry heavy, medium and light crudes are separated by API numbers, which are indicative of density. Heavy crude is collected from condenser #1, whereas light and medium crudes are collected by condenser #2. The light crude comes out with water, which is delivered to an oil-water separator known in the art. The heavy crude is preferably pumped back into a reflux chamber in the bottom half of condenser #1 to continue to crack the heavy crude and recover a higher percentage of sweet and light crude products. This also creates more gas products in condenser #3.

As flow rate is an important consideration in condensation, a distinction should be made between CFM (cubic feet per minute) and ACFM, or actual CFM, which takes temperature into account. At 1400° F., the temperature of the processing gas entering the well has a flow rate of approximately 840 ACFM. Exiting the well the temperature will be near 1400° F. but the flow rate could reach as high as 2000 ACFM depending on product content. Once the liquid products are removed and the gases get cooled down to 80° for condensation purposes, the flow rate gets reduced to approximately about 200 ACFM. These considerations are particularly important in the last condenser stage, which uses pressure loops and critical orifices to recover the individual gaseous products.

Figure 2:
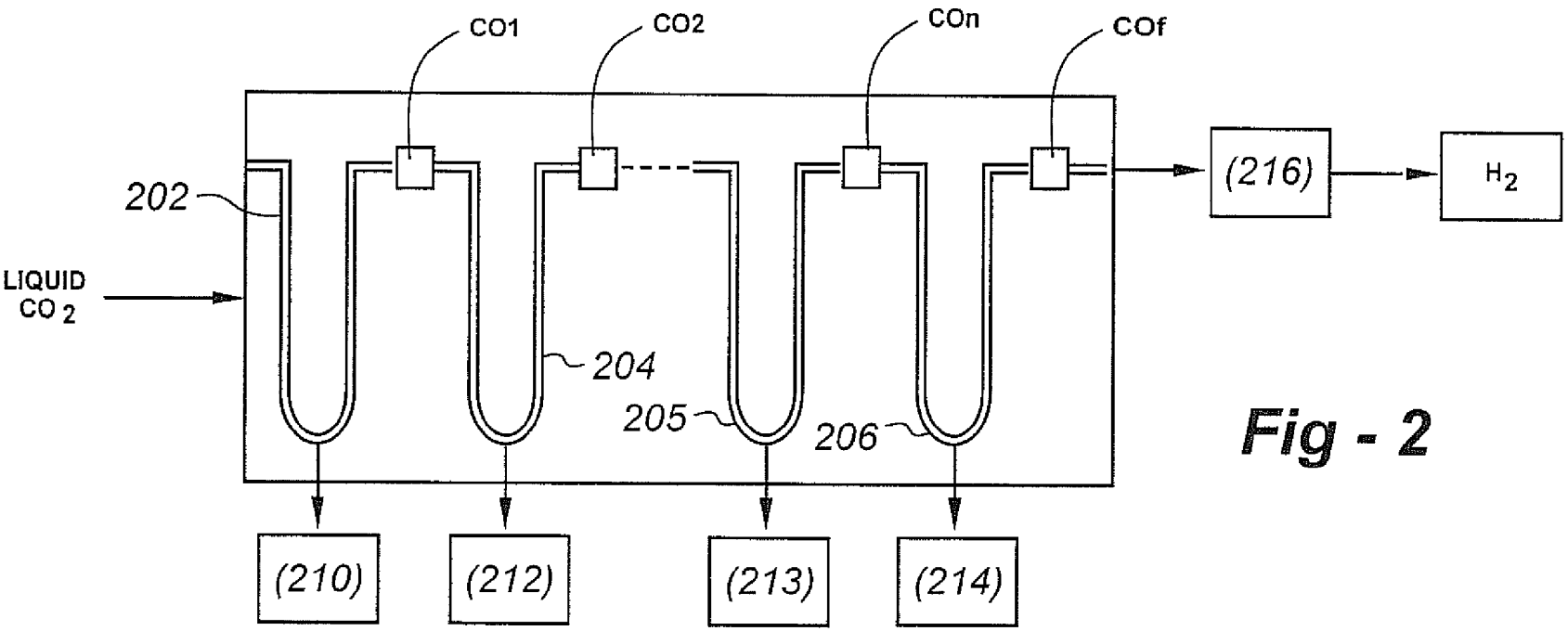
FIG. 2 is a detail drawing of a third condenser unit.

FIG. 2 is a detail drawing that focuses on the final stage of condensation. The condenser unit is actually a set of condensers enabling various components to be divided out in terms of temperature and pressure on an individualized basis. Condenser #3 includes a sealed, insulated housing filled with a coolant, preferably liquefied $CO_2$. Conveniently, the liquid $CO_2$ is recovered by condenser #3 itself, as described in further detail below.

The inside of condenser #3 is maintained at a temperature of about −80 to −100° F. from the liquid carbon dioxide. Immersed in the liquid $CO_2$ are a series of loops, each with a certain length, and each being followed by a critical orifice that establishes a pressure differential from loop to loop. The length of each loop establishes a residency time related to the volume of the individual components within the gas mixture.

Each loop between each set of orifices is physically configured to control the pressure in that loop as a function of the temperature within the condenser, causing particular liquefied gases to become collectable at different stages. In FIG. 2, loop 202 and critical orifice CO1 are configured to recover propane and butane, which is collected at 210. Loop 204 and critical orifice CO2 are configured to recover $CO_2$, which is collected at 212. Loop 205 and critical orifice COn are configured to recover methane, which is collected at 213. Loop 206 and critical orifice COf are configured to recover nitrogen, which is collected at 214. Following the final critical orifice, COf hydrogen is recovered. A compressor 216 not only compresses the collected hydrogen gas into a tank, in conjunction with product condensation and removal it creates a negative pressure back up the line, between condensers #2 and #3, and all the way down into the well. The significance of this negative pressure will be addressed in subsequent sections.

The purity of the collected gaseous products may vary somewhat. Methane, for example, is quite pure, and the hydrogen is extremely pure. All of the gaseous products are collected in the liquid state, and all are maintained as liquids except hydrogen, which emerges as a gas and it not compressed into a liquid (although it could be). The propane may be mixed with butane, and may be kept as a combined product or separated using known techniques. To assist in the recovery of the gaseous products into a liquefied state, there is an initial storage tanks for these products built into the condenser or at least physically coupled to the condenser to take advantage of the cooled $CO_2$ from where the recovered products are then pumped into external pressurized storage tanks.

The only materials which pass through the critical orifices are in the gaseous state. In terms Of dimensions, the input to condenser #3 may have a diameter on the order of several inches. The critical orifices will also vary from ⅛" or less initially down to the micron range toward the output of the unit.

As mentioned, the goal of this aspect of the invention is recover all products on the collection side of the well and, in some cases, use those products where applicable for processing gas formation or product collection. In addition to the collected liquid $CO_2$ being used to cool condenser #3, the combustible gases may be used to run the combustor, particularly if the combustor has a BTU rating which is higher than necessary. For example, if the combustor needs a BTU in the 1000 to 1100 BTU range, combustible gasses lice propane and butane collected from compressor #3 may be mixed with recovered combustible gases such as low BTU gas like hydrogen or an inert gas like nitrogen to achieve this rating.

In terms of dimensions, condensers #1 and #2 may be on the order of 4 feet in diameter and 20 feet long, whereas compressor #3 may be 2+ feet by 8 feet, not including the compressors or the tanks. All such sizes, pipe diameters, and so forth, are volume dependent. Whereas, in the preferred embodiment, the injection and collection equipment may be used for multiple wells, such as 16 wells, but they could used for more or fewer with appropriate dimensional scaling.

Physical aspects of condenser #3 will also vary as a function of the installation; in other words, the actual size of the loop within each phase may vary as a function of gas content which might be site-specific. Accordingly, prior to operation if not fabrication, an instrument such as an in-line gas chromatograph may be used to determine the composition of the flow into condenser #3. The analysis may then be used to adjust the physical dimensions of the unit; for example, to construct a condenser which is specific to that site in terms of what products and/or contaminants are being produced.

Use of the Venturi Effect

Referring back to FIG. 1, the temperature differential of approximately 1400° F. to 650° F. across condenser #1. This establishes a negative pressure in view of the fact that liquid products are recovered from the unit. The same is true with condenser #2, which goes from approximately 650° F. to 250° and then another 200°, 180° temperature differential before the output goes to condenser number three.

Oil shale is present in various strata, with significant horizontal permeability and very little vertical permeability. The horizontal permeability of one layer might be quite different from the permeability of other layers. The use of compressor 216 in conjunction with pressure differentials across the condensers, establishes a negative pressure all the way down into the well. As vapor molecules leaving the well are pulled across the face of the rock, a Venturi effect is created that effectively draws the now heated kerogen out of these horizontally permeable strata. This action improves extraction, facilitating an active rather than passive collection of products.

Physical Parameter Adjustment

The combination of various physical parameters associated with the invention allows for a wide rage of adjustments in overall operation. As one example, assume that the system is producing an undesirable high percentage of heavy crude. Several things may be done to rectify such a situation. Excess heavy crude may means that the kerogen is not being cracked as efficiently as it could be. One solution is to slow down the flow rate of the processing gas being pumped down into the well, thereby increasing the residency time of the heated gas. Alternatively, the temperature of the processing gas may be increased to enhance cracking down in the well, thereby reducing the amount of heavy crude. As a further alternative, reflux time in condenser #1 may be increased. Such techniques may be used alone or in combination.

Indeed, according to the invention, various physical parameters may be adjusted to alter the ratio of products and/or the amount of gas collected in the end. These parameters include the following:

processing gas temperature;
processing gas pressure;
flow rate;
residency time;
reflux time;
condenser temperature; and
the negative pressure throughout the collection side of the system.

These parameters may be 'tuned' to maximize product output. However, such adjustments may have other consequences. For example, a higher processing gas residency time in the well might increase carbon monoxide production, which could lead to secondary effects associated with the liquids extracted, the oil liquid extracted, and/or the liquefied gases taken out of the third condenser.

The adjustment of physical parameters may also have an effect upon contaminant generation. Oil shale is a compressed organic material which contains elements such as sulfur from pyrite or other contaminants or minerals. One advantage of the instant invention is that the well is operated at a very reducing environment, preferably less than 1 percent oxygen, such that reactions with materials such as sulfur are minimized. Nevertheless, the physical parameters discussed above may be adjusted to reduce the level of contaminants such as sulfur.

Opportunities for Carbon Sequestration

Another advantage made possible by the invention is the opportunity for large-scale carbon sequestration. Certain existing carbon sequestration processes simply fill abandoned mines with carbon dioxide which, being heavier than air, ideally remains in place. However, cracks and fissures may exist or develop, allowing the gas to leak out. In addition, the large surface area of the mine is not used directly, thereby reducing the potential efficiency of the sequestration process.

According to this invention, when kerogen is cracked and removed from the wells recovery cylinder, the remaining product at high temperature exhibits a vast system of micropores that are coated with char. Resulting in an enormous surface area which allows for the direct adsorption of carbon dioxide. Accordingly, following a mining operation, carbon dioxide may be pumped down into the well to be adsorped by these porous materials.

Figure 3:
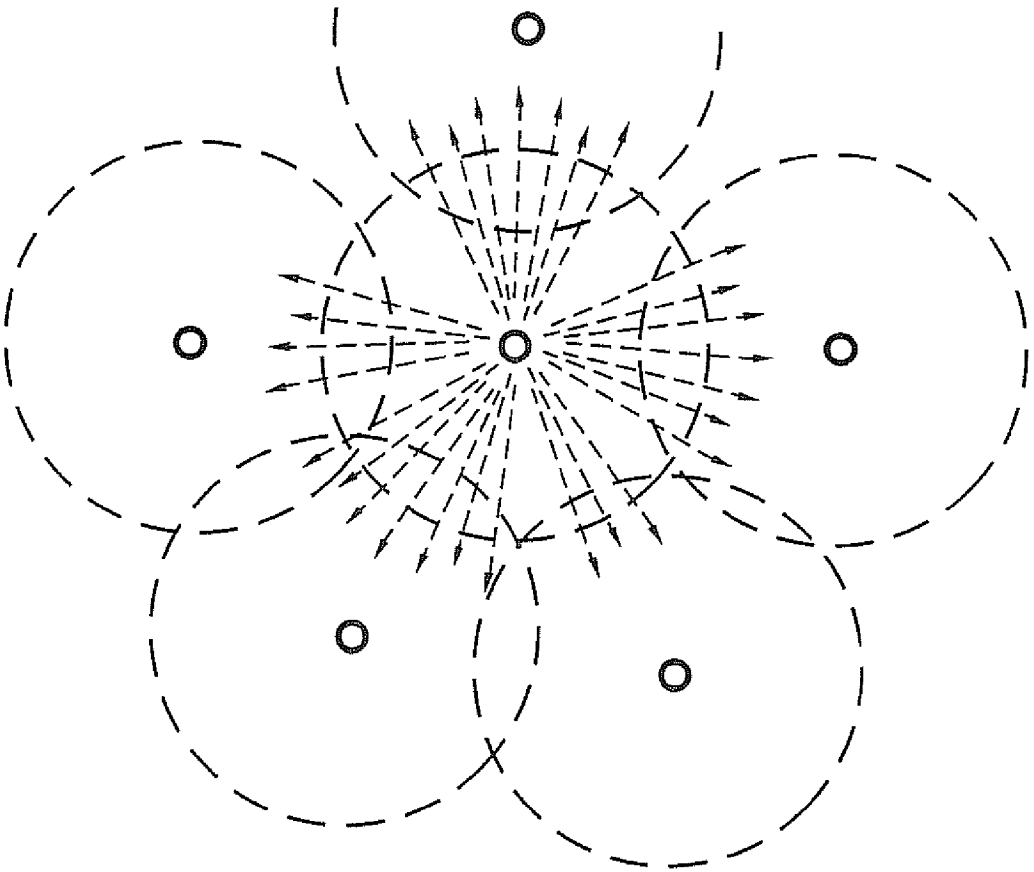
FIG. 3 shows how depleted wells may be used for carbon sequestration.

FIG. 3 is a top-down view of a multi-well operation. The small circles depict the well holes, while the dashed lines indicated depleted kerogen. As the drawing shows, these depleted regions may overlap in places. According to the invention, a central well is selected for $CO_2$ injection. The injected gas migrates toward the other wells which are not being injected. If there were only one well, or if the depleted regions of multiple wells did not overlap, the injected $CO_2$ may ultimately find its way to the other wells through natural diffusion. However, this is an exceedingly slow mass transport process due to the fact that diffusion depends upon a concentration gradient. However, with overlapping regions of depleted kerogen a high degree of permeability exists from one well to another and a much more active mass transport process based upon dispersion or advection may occur, which is orders of magnitude faster than diffusion.

During this process, the uncapped wells around the injection well will be monitored, and when a sufficient level of $CO_2$ is detected, a desired level of saturation can be determined. Again, the $CO_2$ used for injection may be derived from the system itself, through the output of condenser #3, described above. As such, the $CO_2$ may be injected in liquid form. Overall, it may be possible to achieve a 70 to 80 percent replacement of volume for the cracked kerogen removed which would relate to multiple equivalent volumes of $CO_2$ by mass.

Modifications for Oil and Tar Sands

The systems just described may be useful not only in oil shale, but also in oil/tar sands with appropriate engineering modification. In oil shale, kerogen is cracked, which has a molecular weight on the order of 1000 Daltons or greater. With oil and tar sands bitumen is being cracked, which has a molecular weight of about half that of kerogen. In fact, when cracking kerogen, a transition occurs from kerogen to bitumen to oil products. As such, with oil and tar sand an initial high-temperature cracking and gasification step is not necessary. Temperatures on the order of 600° F. to 800° F. are useful as opposed to the 1200° F. to 1600° F. used for kerogen cracking and gasification. The first condenser described above may therefore be unnecessary.

In contrast to oil shale, oil/tar sands are generally not stratified but instead exhibit omnidirectional permeability. As such the use of the Venturi effect discussed above is not available. Additionally, since sands "flow," provisions need to be made for the well casing to ensure against fill-in.

Figure 4:
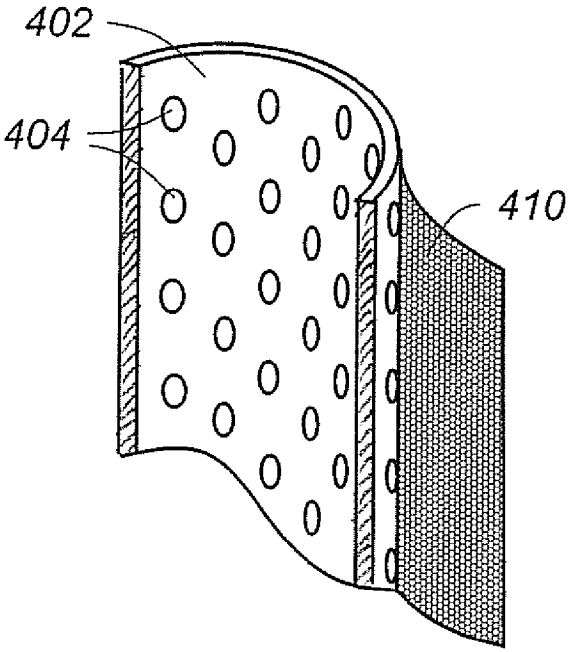
FIG. 4 is a simplified drawing of a casing applicable to oil and tar sand extraction operations.

According to the invention, for oil/tar sand applications, a central, in-well pipe with apertures would be placed during the drilling operation. The apertures may include small holes, diagonal cuts, mesh features, and so forth, depending upon material composition and potential flow rate. For example, as shown in FIG. 4, perforations 404 on the order of an inch or thereabouts would be provided throughout the length of the pipe 402 and, behind that (against the sands) a screen 410 with much smaller opening would be used. The holes may be cut or punched into the pipe at a vertical angle to restrict sands from falling back into the well hole. Materials similar to window screen could be used, though high-integrity 304 stainless steel would be used for construction.

To sink the well, a flat coring bit would be used, with the casing just described following directly behind that. The casing would be installed during the drilling process. The material removed during the drilling process would be pumped up through the casing. When the coring bit reaches its destination, it remains in position with casing situated above it.

We claim:

1. A method of recovering hydrocarbonaceous and other products from non-rubbilized oil shale and oil/tar sands, comprising the steps of:

forming a hole in a body of the oil shale or sand;
positioning a gas inlet conduit into the hole;
heating and pressurizing a processing gas;
introducing the processing gas into the hole through the gas inlet conduit, thereby creating a nonburning thermal energy front sufficient to convert kerogen in oil shale or bitumen in oil sand to hydrocarbonaceous products;
withdrawing the processing gas and hydrocarbonaceous products as effluent gas through the hole;

performing first and second initial condensation steps to separately recover and store heavy and sweet crude oil products from the effluent gas; and performing one or more subsequent condensation steps to recover and store additional liquefied products from the effluent gas.

2. The method of claim 1, wherein the step of performing one or more subsequent condensation steps includes the recovery of one or more of the following additional products:

liquefied ethane, liquefied propane, liquefied butane, liquefied carbon dioxide, liquefied methane, liquefied nitrogen, and hydrogen.

3. The method of claim 1, including the steps of:

burning a fuel that produces an exhaust gas and heat within a heat exchanger; and routing the exhaust gas through the heat exchanger to create the processing gas.

4. The method of claim 1, including the steps of:

burning a fuel that produces an exhaust gas and heat within a heat exchanger;

mixing at least one of the additional products with the exhaust gas; and routing the mixture through the heat exchanger to create the processing gas.

5. The method of claim 1, including the step of controlling the composition of the processing gas so that it is oxygen-deprived.

6. The method of claim 1, including the step of controlling the composition of the processing gas so that it contains approximately 1% oxygen or less.

7. The method of claim 1, further including the step of maintaining the effluent gas under a relative negative pressure from the hole and through the initial and subsequent condensation steps.

8. The method of claim 1, including the steps of:

performing the subsequent condensation steps in at least one cooled chamber having an input and an output; and providing a compressor at the output of the cooled chamber to maintain the effluent gas at a negative pressure from the hole and through the initial and subsequent condensation steps.

9. The method of claim 1, including the step of performing the subsequent condensation steps in at least one cooled chamber having an input, an output, and a plurality of critical orifices sized to recover the other products.

10. The method of claim 1, wherein:

one of the other products is liquid carbon dioxide; and the subsequent condensation steps are performed in a chamber cooled with the liquid carbon dioxide.

11. The method of claim 1, wherein:

one of the other products is liquid carbon dioxide; and the subsequent condensation steps are performed in a chamber cooled with the liquid carbon dioxide and including critical orifices sized to recover the other products.

12. The method of claim 1 wherein, in oil shale, the step of withdrawing the processing gas and hydrocarbonaceous products as effluent gas through the hole is sufficient to withdraw at least a portion of the hydrocarbonaceous products from the shale through the Venturi effect.

13. The method of claim 1, wherein one of the other products is carbon dioxide, the method further including a carbon sequestration step wherein the carbon dioxide is delivered down the hole following the recovery of the hydrocarbonaceous products.

14. The method of claim 1, further including the steps of:

forming a plurality of holes, each with a gas inlet to receive a heated and pressurized processing gas;

withdrawing the processing gas and hydrocarbonaceous products as effluent gas through each hole; and performing a plurality of condensation steps to recover crude oil products and additional products from the effluent gas from a plurality of the holes.

15. The method of claim 1, wherein one of the other products is carbon dioxide, the method further including carbon sequestration steps comprising:

forming a plurality of holes, each with a gas inlet to receive a heated and pressurized processing gas, the holes being arranged as a central hole and a plurality of surrounding holes;

withdrawing the processing gas and hydrocarbonaceous products as effluent gas through each hole;

performing a plurality of condensation steps to recover crude oil products and additional products from the effluent gas from a plurality of the holes; and introducing the carbon dioxide down the hole following the recovery of the hydrocarbonaceous products until the carbon dioxide is detected at one or more of the surrounding holes.

16. The method of claim 1, wherein the crude oil is obtained as a ratio of heavy crude to lighter crudes, the method further including the step of reducing the flow rate of the processing gas to reduce the ratio.

17. The method of claim 1, wherein the crude oil is obtained as a ratio of heavy crude to lighter crudes, the method further including the step of increasing the reflux time of the heavy crude with respect to the initial condensation step to reduce the ratio.

18. The method of claim 1, including the step of adjusting one or more of the following parameters to vary the recovery of crude oil, other products or contaminants from the effluent gas:

the temperature, pressure or flow rate of the processing gas, the residency time of the processing gas in the hole, the reflux time of the crude oil with respect to the initial condensation step.

19. The method of claim 1, including the step of providing an apertured sleeve within the hole to extract hydrocarbonaceous products from oil/tar sands.

20. A system for recovering hydrocarbonaceous and other products from a hole drilled in non-rubbilized oil shale and oil/tar sands, the system comprising:

a combustor for heating and pressurizing a processing gas;

a gas inlet conduit for introducing the processing gas into the hole to convert kerogen in oil shale or bitumen in oil sand into hydrocarbonaceous products;

a gas outlet conduit for withdrawing the processing gas and hydrocarbonaceous products from the hole;

an initial condenser system for separately recovering heavy and sweet crude oil products from the effluent gas;

one or more tanks for storing the recovered crude oil products;

a subsequent condenser system for recovering additional liquefied products from the effluent gas; and one or more tanks for storing the additional liquefied products.

21. The system of claim 20, wherein the subsequent condenser system is operative to recover of one or more of the following additional products:

liquefied ethane,
liquefied propane,
liquefied butane,
liquefied carbon dioxide,
liquefied methane,
liquefied nitrogen, and
hydrogen.

22. The system of claim 20, wherein:

the combustor produces an exhaust gas, the system further including a heat exchanger heated by the combustor; and the processing gas is generated by heating the exhaust gas with the heat exchanger.

23. The system of claim 20, wherein the combustor produces an exhaust gas, the system further including:

one or more conduits for routing the at least one of the additional products with the exhaust gas; and the processing gas is generated by heating the mixture of the exhaust gas and the additional products with the heat exchanger.

24. The system of claim 20, further including a compressor for maintaining the effluent gas under a negative pressure from the hole and through the condenser systems.

25. The system of claim 20, wherein the subsequent condenser system includes:

a cooled chamber; and a plurality of conduit loops within the chamber, each followed by a critical orifice, each loop and following critical orifice being physically configured to condense a different one of the additional products.

26. The system of claim 20, wherein the subsequent condenser system includes:

a cooled chamber;

a plurality of conduit loops within the chamber, each followed by a critical orifice, each loop and following critical orifice being physically configured to condense a different one of the additional products; and wherein one of the additional products is liquefied carbon dioxide which is used to cool the chamber.

27. The system of claim 20, further including:

a plurality of gas inlet conduits, each situated in a separately drilled hole;

a plurality of gas outlet conduits, each withdrawing the processing gas and hydrocarbonaceous products as effluent gas through a respective one of the holes; and wherein the condenser systems are fed by a plurality of the gas outlet conduits.

28. The system of claim 20, wherein the initial condenser system includes a reflux chamber to reduce the ratio of heavy crude to lighter crudes.

29. The system of claim 20, wherein the gas outlet conduit is in gaseous communication with an apertured sleeve disposed within the hole to extract hydrocarbonaceous products from oil/tar sands.

* * * * *

UNITED STATES PATENT AND TRADEMARK OFFICE

CERTIFICATE OF CORRECTION

PATENT NO. : 8,312,928 B2
APPLICATION NO. : 12/421325
DATED : November 20, 2012
INVENTOR(S) : Michael D. Lockhart et al.

It is certified that error appears in the above-identified patent and that said Letters Patent is hereby corrected as shown below:

In the Specification:

At column 6, line number 15, Delete “chancing”, Insert --changing--

At column 7, line number 46, Delete “COf”, Insert --COf,--

At column 7, line number 67, Delete “Of”, Insert --of--

At column 8, line number 13, Delete “lice”, Insert --like--

Signed and Sealed this
Sixth Day of January, 2015

Michelle K. Lee

Michelle K. Lee
*Deputy Director of the United States Patent and Trademark Office*